United States Patent [19]

Wilson

[11] Patent Number: 4,614,332

[45] Date of Patent: Sep. 30, 1986

[54] SNATCH BLOCK WITH IMPROVED HOOK BOLT ASSEMBLY

[75] Inventor: Earl E. Wilson, Claremore, Okla.

[73] Assignee: The Crosby Group, Inc., Tulsa, Okla.

[21] Appl. No.: 693,593

[22] Filed: Jan. 22, 1985

[51] Int. Cl.[4] ..... B66C 1/14; B66D 3/04

[52] U.S. Cl. ..... 254/405; 254/406

[58] Field of Search ..... 254/389, 390, 401, 402, 254/405, 406, 408, 409

[56] References Cited

U.S. PATENT DOCUMENTS

| | | | |
|---|---|---|---|
| 1,070,834 | 8/1913 | Nissen | 254/406 |
| 1,114,814 | 10/1914 | Smith | 254/406 |
| 2,162,080 | 6/1939 | Hacker | 254/406 |
| 2,288,116 | 6/1942 | Stillwagon | 254/405 |
| 2,366,636 | 1/1945 | McKissick et al. | 254/406 |
| 2,474,433 | 6/1949 | McKissick | 254/406 |
| 2,649,282 | 8/1953 | Fate | 254/406 |
| 2,741,458 | 4/1956 | Le Bus | 254/406 |

*Primary Examiner*—Donald Watkins

*Attorney, Agent, or Firm*—Head, Johnson & Stevenson

[57] ABSTRACT

This concerns a snatch block for free stringing rope to a sheave supported between two side plates, one of which is movable. One of the side plates, called a swing plate, is rotatable with respect to the sheave. A removable bolt holds the two side plates together. Means are provided to prevent the bolt from falling completely out of the non-movable side plate when the other side plate is moved. Further, special means are provided for the bolt to help support the spool and further novel means are provided to aid in preventing the trunnion and hook from falling off the spool when the side plate is swung free.

8 Claims, 9 Drawing Figures

SNATCH BLOCK WITH IMPROVED HOOK BOLT ASSEMBLY

BACKGROUND OF THE INVENTION

This invention relates to improvements in snatch blocks and particularly to snatch blocks with two side plates, one of which is called the swing plate and is pivoted about the sheave bolt which is between the two side plates. Snatch blocks in general are well known and are described, for example, in U.S. Pat. No. 2,366,636; U.S. Pat. No. 2,474,433 and U.S. Pat. No. 2,649,282. These are cited to show generally the configurations of typical snatch blocks. Snatch blocks are typically composed of two spaced apart parallel side plates each having a hole spaced from the sheave bolt. A spool is welded to one of the plates and the holes are normally aligned with the hole of the spool. A bolt goes through the holes and the spool is fastened to a nut to hold the swing plate in position. A hook with a trunnion or becket is supported by the spool. The three patents just cited generally show typical snatch blocks.

SUMMARY OF THE INVENTION

My invention concerns an improved snatch block which makes the snatch block more versatile. One object is a lower bolt with a new retaining mechanism which will keep the lower bolt intact with the block when the swing plate is opened and also adds friction between the bolt and the swing plate when in the operating position. It is a further object to also provide an improved method of adding support to the spool which supports the trunnion or becket to which the hook for supporting weight may be attached. A further object is to provide for interchanging the lower connection such as exchanging a hook assembly for a clevis assembly without taking the block completely apart.

In my invention I have a first side plate and a second or swing side plate which are normally of about the same configuration. A sheave supporting means for supporting a wire rope or line is supported by and held between the two side plates. One of the side plates is fixed to the supporting means and the other side plate is rotatable therewith so that one side plate can rotate or open with respect to the other.

Spaced from the sheave supporting means is a hole in each side plate which holes are aligned. A spool member is attached to one of the side plates and has a hole through the spool member which is slightly larger than the diameter of the bolt which extends through the holes in the two side plates. The periphery of the hole of the spool adjacent the side toward the sheave supporting means is aligned with the periphery of the holes in the side plates. This permits the bolt to support the spool member.

The bolt which extends through the spool member is threaded at the end which extends into the swing plate. At the butt of the threads is a groove in which is placed a C-spring. When the snatch block is completely made up, this C-spring is positioned inside the swinging side plate. When the bolt or side plate is to be removed or opened so that restringing can occur, the bolt is screwed out of the swinging plate but the C-spring abutts the shoulder of the hole of the fixed plate and prevents the bolt from falling out.

Sometimes I want to be able to interchange the lower connection such as taking out a hook assembly and adding a clevis assembly without taking the block completely apart. I can accomplish this by machining a slot or a flat area on one side of the spool and removing metal from the inside of the yoke. This enables the yoke to be lifted off the spool in one position only. In all other positions it cannot be lifted off and this aids in preventing the lower assembly connection from falling off but still permits the interchangement thereof.

Various other objects and a better understanding of the invention can be had from the following description taken in conjunction with the drawings.

DRAWINGS

DETAILED DESCRIPTION OF THE PREFERRED EMBODIMENT

Figure 1:
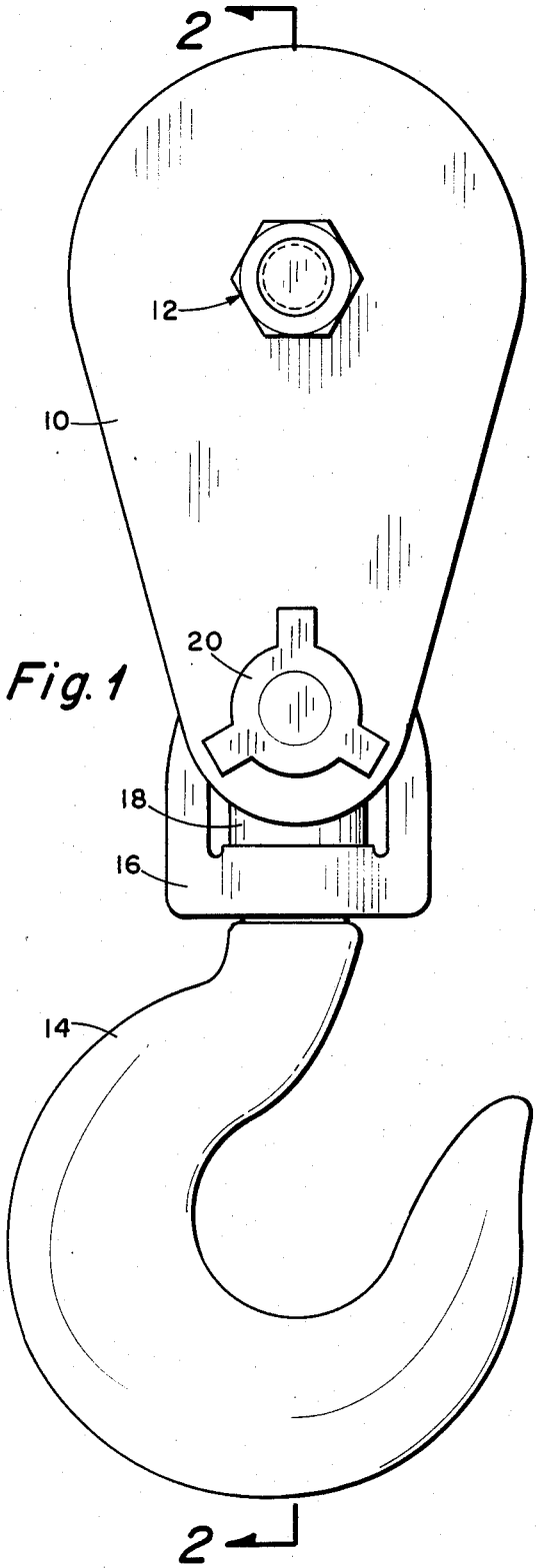
FIG. 1 is a side elevation of one form of the snatch block in closed position.
Figure 2:
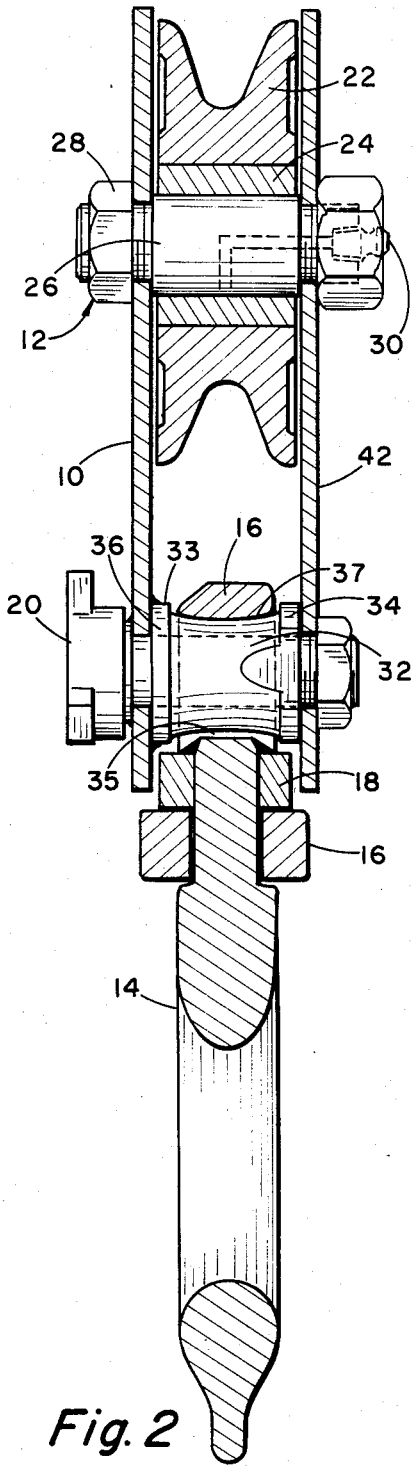
FIG. 2 is a sectional view taken along the line 2—2 of FIG. 1.

Attention is first directed to FIGS. 1 and 2 for an overall view of the improved snatch block of my invention. Shown thereon is a first side plate 10 and a second or swing side plate 42. Support means 12 holds the two plates apart and also supports the sheave member 22 over which the cable or rope will be threaded. Sheave member 22 is supported on a bearing 24 which is supported by bolt 26 extending between the outside of the two side plates and is held in position by a nut 28 threadily connected thereon. A zerk means 30 is also provided for inserting lubrications to the bearing.

Spaced from the sheave support means is a spool or tubular member 32 which is attached to side plate 10 such as by weld 36. The other side of the spool is not welded to side plate 42. The spool or tubular member 32 is provided with a first shoulder or flange 33 and a second end flange 34 with a cradle 37 therebetween which supports becket or trunnion 16. A nut 35 supports the swivel hook 14 from the trunnion 16.

Figure 3:
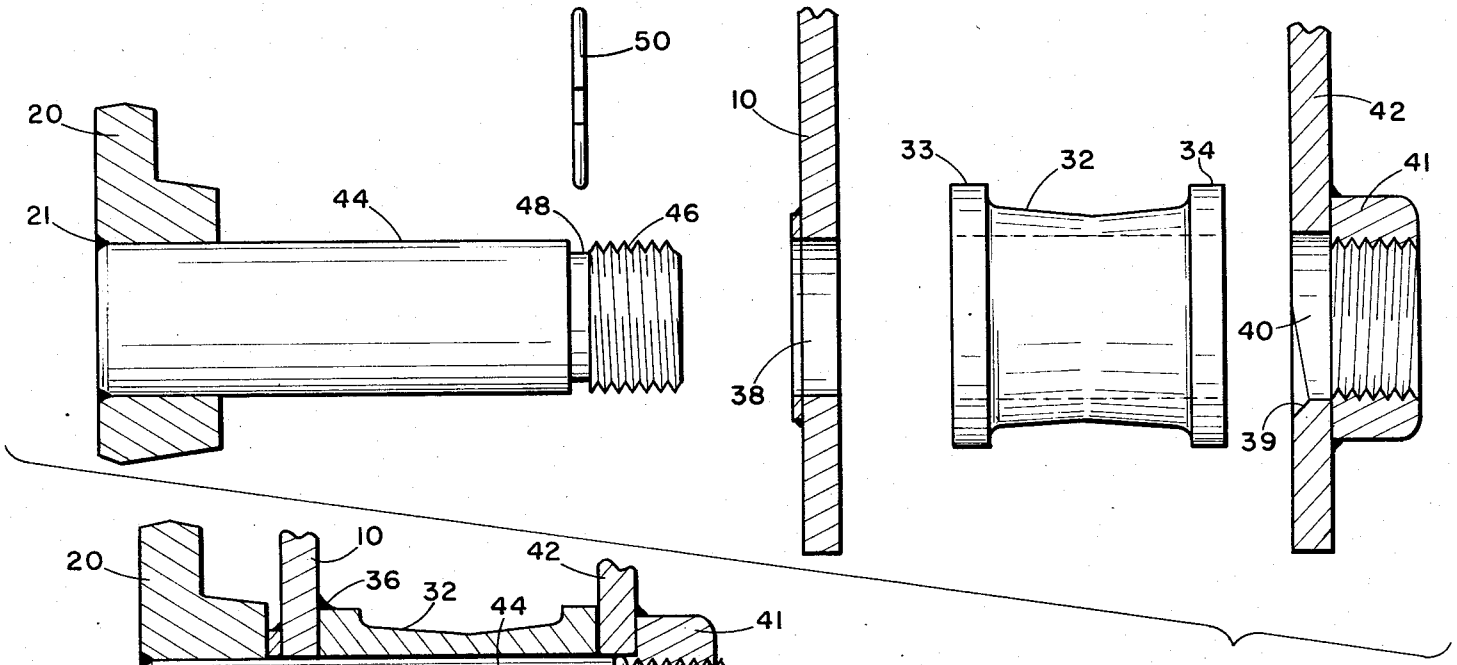
FIG. 3 is an exploded view of the side plates, spool and bolt.
Figure 4:
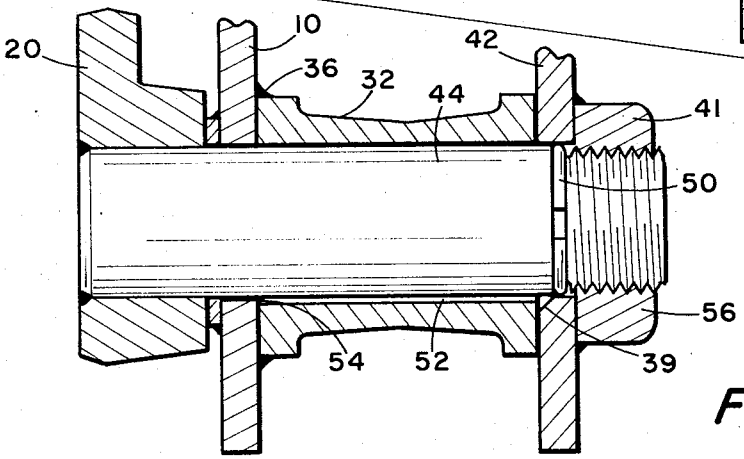
FIG. 4 is an assembled view of the parts of FIG. 3.

Attention is next directed to FIG. 3 which shows an exploded view of the spool 32 and associated parts including the holes through the side plates 10 and 42 and bolt 44. Bolt 44 is provided with a head 20 which is attached to the bolt by weld 21. The other end of the bolt is provided with a thread 46 and a groove or recess 48 at the butt of the threads into which a C-spring 50 is placed. A nut 41 is welded to side plate 42 and adjacent hole 40. The bolt 44 is aligned to be inserted through hole 38 of the side plate 10, the passage through spool 32 to hole 40 of plate 42 and connected to the threads of nut 41. These assembled parts are shown in FIG. 4 in which the bolt 44 is inserted and is threadedly connected to nut 41. This secures the two side plates 10 and 42 in a locked position. Spool 32 is attached to side plate 10. The hole in the spool 32 is slightly larger than the holes 38 and 40. When the upper most edge of the hole in the spool 32 is aligned with the upper most part of the holes 38 and 40, there is provided a gap 52 between the bolt 44 and the periphery or internal wall of the spool passage at the lower side. By upper side we mean the side nearest the sheave support member and by lower side we mean the side furtherest away. The snatch block can be used in any desired position. The C-spring 50 is inserted into groove 48.

The hole 40 in side plate 42 is preferably slightly larger than the hole 38 inside the plate 10 and is provided with a chamfer 39 which, as will be seen, is useful for letting C-spring 50 enter into the hole 40 when it is reassembled.

Figure 5:
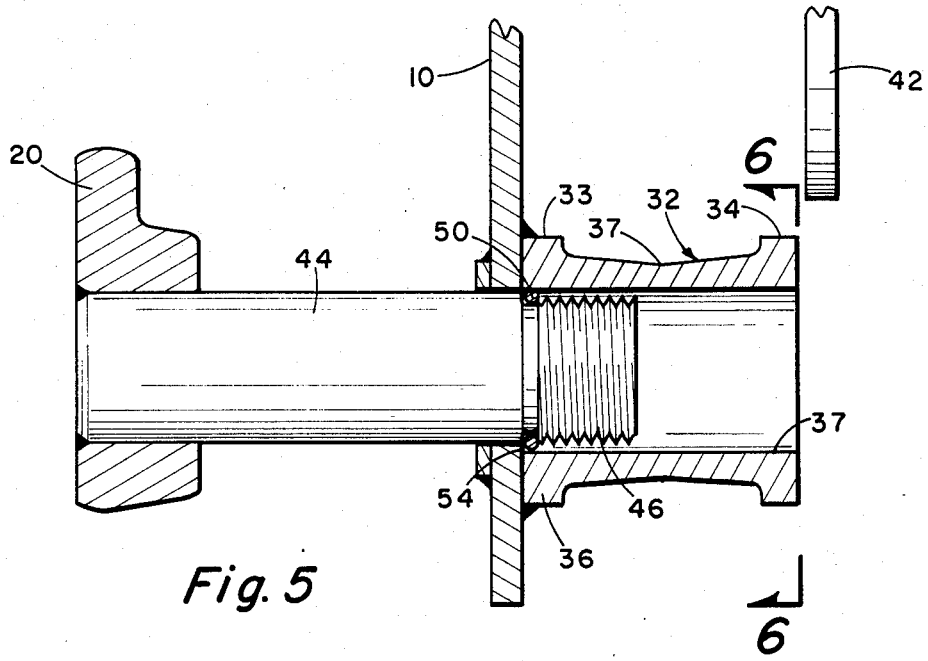
FIG. 5 shows the swing side plate swung free and the bolt in the open but retained position.

When it is desired to replace a rope, for example, head 20 is turned to loosen bolt 44 from side plate 42 until it reaches a position in FIG. 5 and plate 42 is free to swing to one side to permit the string of rope through the block. It will probably be necessary to hammer the head 20 loose. As can be seen in FIG. 5, the C-spring 50 has expanded and contact shoulder 54. This prevents the bolt 44 from falling out of the hole in side plate 10. Once the stringing of the rope has been completed, side plate 42 is swung back into position and bolt 44 is then inserted into threaded nut 41. As the bolt 44 is continued to be tightened, the C-spring 50 is forced against the chamfered surface 39 and is compressed sufficiently so that it can enter the hole and be in frictional contact with the interior or bore of hole 40 creating a friction against movement. This compression of the spring and the friction will help maintain the bolt 44 in its full made up position. However, it will still be necessary to tighten the bolt, preferably by use of a hammer on head 20.

Figure 6:
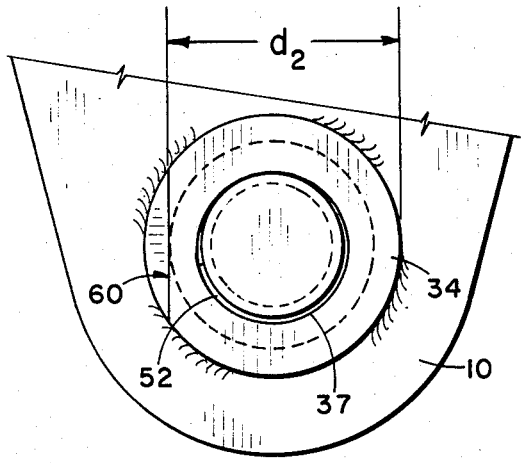
FIG. 6 is a view taken along the line 6—6 of FIG. 5.
Figure 9:
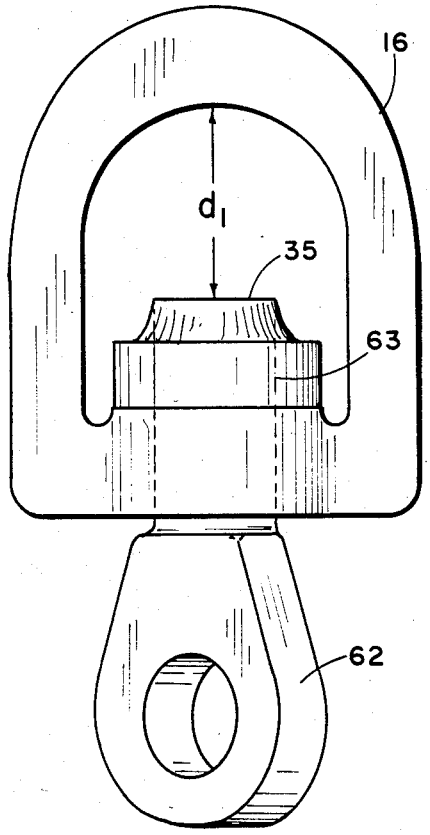
FIG. 9 shows a swivel eye trunnion assembly.
Figure 8:
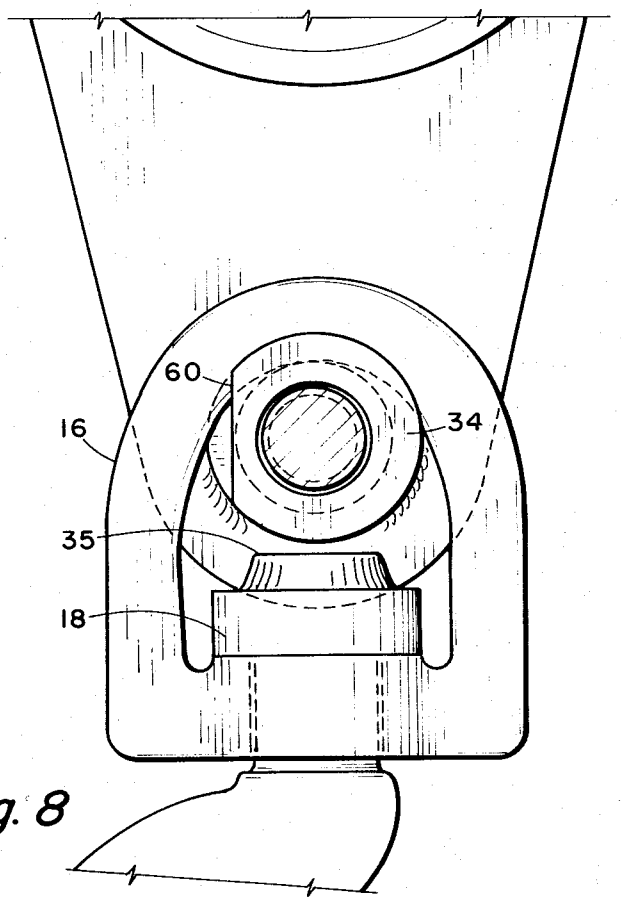
FIG. 8 shows a trunnion in a non-removable position with repect to the spool member.
Figure 7:
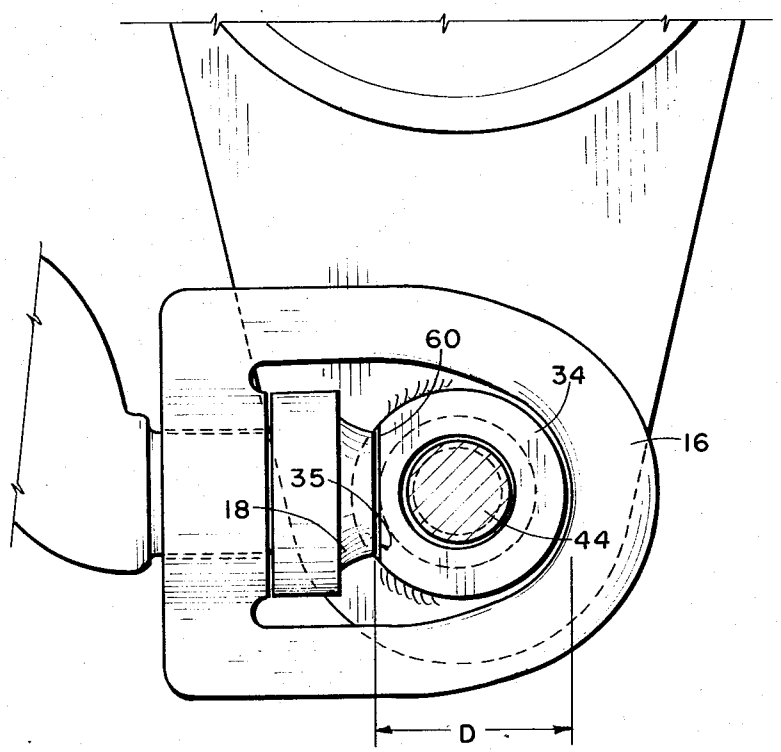
FIG. 7 shows a trunnion in a removable position with respect to the spool.

It is frequently desired to interchange the lower connection, that is, remove the swivel hook 14 and replace it with another device such as the swivel eye 62 shown in FIG. 9 without taking the block completely apart. I accomplish this by machining a flat or cut-off portion 60 on one side of the spool as shown in FIGS. 6, 7 and 8. Attention is directed to FIG. 9 to show tne swivel eye connection 62 which has a nut 63 with a flat top. There is shown a distance $D_1$ from the top of the nut 63 to the crest of the stirrup of the trunnion 16. This $D_1$ is slightly greater than $D_2$ as shown in FIG. 6 which is the distance from the cut-off area 60 to the opposite side of the spool 32. The cut-off 60 is along the chord of the circle of the flange 34 of the spool 32.

When I want to interchange the lower connection, such as removing the swivel hook of FIG. 1 and replacing it with the swivel eye of FIG. 9, I unscrew bolt 44 to the position shown in FIG. 5 and swing side plate 42 to one side. I then rotate the trunnion until its flat side 35 is aligned with the flat side 60 of the spool as indicated in FIG. 7. I can then lift the swivel hook and trunnion off the spool. This is the only position at which I can do this. I then replace it with the trunnion 16 and swivel eye 62 of FIG. 9, for example. and place it on the spool in the only way possible by having the flat surfaces aligned with the flat surface of nut 63. I then rotate it to the position shown in FIG. 8 at which position the trunnion 16 cannot fall off the spool or tubular member 32.

While the invention has been described with a certain degree of particularity, it is manifest that many changes may be made in the details of construction without departing from the spirit and scope of this disclosure. It is understood that the invention is not limited to the embodiments set forth herein for purposes of exemplification, but is limited only by the scope of the attached claim or claims, including the full range of equivalency to which each element thereof is entitled.

What is claimed:

1. A snatch block comprising:

a first side plate having a first hole therein;

a swing plate having a second hole therein;

sheave supporting means positioned between said side plates, said swing plate being pivotable about said supporting means;

a bolt insertable through said holes for holding said side plates;

a spool member attached to said first side plate and having a hole therethrough whose diameter is slightly larger than the diameter of said first hole, the top of said first hole and the top of the hole in said spool member and the top of said second hole being aligned;

retaining means to retain said bolt within said first hole;

the bolt being of uniform diameter for a length at least about that of the length of the hole in said spool member so that the bolt is in full length contact with the spool member when assembled.

2. A snatch block as defined in claim 1 in which said retaining means includes a groove in said bolt at the base of its threads and a C-spring in said groove.

3. A snatch block as defined in claim 2 in which the inside of the hole of the swing side plate is chamfered to permit the C-spring to be compressed by motion of said bolt through said hole.

4. A snatch block as defined in claim 1 in which said spool member has shoulders at each end forming a recess therebetween for receiving a trunnion.

5. A snatch block as defined in claim 4 in which the shoulder of said spool member adjacent to said swing plate is shaped in partial periphery as a circle with a cord segment.

6. In a snatch block comprising a first side plate having a first hole and a second side plate having a second hole and a sheave rotatably held between a first plate and a swinging side plate, the improvement comprising:

a spool fixed to said first plate and having a hole of larger size than said first hole, the top of said first hole and the top of the hole of said spool being aligned;

a bolt having a head and extendable through said first hole in said plate and through the hole of said spool leaving a gap at the bottom of the hole through said spool, said bolt having threads and a groove at one end of said threads and a snap ring in said groove, the interior side of said hole in said swing plate being chamfered to permit said snap ring to be forced deeper into said groove as said bolt is pushed through said second hole said bolt being of constant diameter between said threads and said head to permit full length contact between said bolt and said spool.

7. A snatch block as defined in claim 6 in which one side of said spool is flat.

8. A snatch block comprising:

a first side plate having a first hole;

a swing side plate having a second hole;

a sheave rotatably held between said side plates;

a spool fixed to said first side plate and having a hole therethrough forming a passage of larger diameter than said first hole;

a bolt extendable through said first hole and said spool leaving a gap between said bolt and the interior of the wall of said spool;

threads on said bolt having a groove at the end thereof;

a snap ring in said groove expandable into said gap so that when said bolt is withdrawn, said snap ring expands and contacts the wall of the said first side plate around said first hole to prevent the complete withdrawal of said bolt;

the inner part of said second hole being chamfered to permit said snap ring to be compressed into said groove as said bolt is forced through said spool.

* * * * *

UNITED STATES PATENT AND TRADEMARK OFFICE

CERTIFICATE OF CORRECTION

PATENT NO. : 4,614,332
DATED : 9/30/86
INVENTOR(S) : EARL E. WILSON

It is certified that error appears in the above-identified patent and that said Letters Patent are hereby corrected as shown below:

Column 4, line 38, "cord" should be --chord--

Signed and Sealed this

Third Day of March, 1987

*Attest:*

DONALD J. QUIGG

*Attesting Officer*

*Commissioner of Patents and Trademarks*